US005350249A

United States Patent [19]

Peters

[11] Patent Number: 5,350,249

[45] Date of Patent: Sep. 27, 1994

[54] BINDER POCKET

[76] Inventor: Grant H. Peters, 3015 N. Greenview, Chicago, Ill. 60657

[21] Appl. No.: 44,978

[22] Filed: Apr. 8, 1993

[51] Int. Cl.[5] ..... B42F 13/40

[52] U.S. Cl. ..... 402/4; 281/31

[58] Field of Search ..... 402/4; 281/29, 30, 31, 281/36

[56] References Cited

U.S. PATENT DOCUMENTS

| | | | |
|---|---|---|---|
| 2,035,571 | 3/1930 | Schade | 281/31 X |
| 2,184,823 | 12/1939 | Vernon | 402/4 |
| 2,647,517 | 8/1953 | Bilbrey | 402/4 |
| 4,336,754 | 6/1982 | Loeb | 281/31 X |
| 4,820,071 | 4/1989 | Steinfeld et al. | 402/4 |
| 4,932,520 | 6/1990 | Ciarcia et al. | 251/31 X |

OTHER PUBLICATIONS

BT Publix, 1993 Office Products Catalog, Cover and p. 306-L2, ring binders.

*Primary Examiner*—Paul A. Bell

*Attorney, Agent, or Firm*—Trexler, Bushnell, Giangiorgi & Blackstone, Ltd.

[57] ABSTRACT

The present invention envisions a pocket on a binder which is formed for holding articles. The pocket is formed in a void of the binder formed between an inside surface of the cover of the binder and a retained edge of components held in a holding device in the binder. Various boundary components in the void define compartments in which the pocket is positioned. Since the void and the compartments therein are empty space not utilized in the binder, articles can be placed in the pocket without interfering with the operation of the binder, the materials retained therein, or the article.

20 Claims, 1 Drawing Sheet

BINDER POCKET

BACKGROUND OF THE INVENTION

The present invention relates to pockets in combination with binders for retaining articles. More specifically, this invention relates to pockets which are disposed in compartments in a void area of a binder and a method for forming such pockets.

Numerous developments in the binder or folder art have resulted in a variety of ways of retaining sheets of paper in a cover in a more or less planar manner. Other components have been designed to be retained with the papers such as additional pockets, accessory pouches, rulers, paper punches, and any number of other items. A number of holding devices have been developed to retaining the paper and other components in the cover. One popular form of holding device is binder rings which are attached to the cover. The rings are divided and are operable so that they can be opened and closed to insert or remove components from the binder. Other holding devices are available such as slide brackets, screw posts, or strapping brackets.

In many binders a void is formed inside of the binder when the binder is closed. The void extends longitudinally along the common edge of the components retained by the holding device. The void is bounded by a first and second edge, such as a top and bottom edge of the cover, a portion of the inside surface of the cover and the common edge of the components. A number of boundary components define compartments in the void. For example, boundary components may include the rings or other retaining device, a finger lever for opening or closing rings, or the top or bottom edge of the cover.

Often times, it is important to retain small articles in a binder such as product samples, containers for holding small product samples, or stationary supplies such as erasers, correction fluid, or self-adhesive note labels, to name just a few. Prior art solutions to retaining these articles in the binder have been to provide storage pouches which attach to the retaining device or to stuff the articles in a pocket formed along one of the front or back covers. This causes a problem in that the items press against the materials retained in the binder such as paper and may disfigure the papers or become crushed when items are stacked on the outside surface of the front or back of the cover or when the binder is forced into a space that is too small such as a brief case or shelf. Additionally, when articles are retained in the binder in the manner as mentioned above, the front and back covers of the binder tend to bulge making it less manageable to carry and less stackable.

As such, it would be desirable to provide a binder which retains articles therein without damaging the articles or the contents of the binder and without effecting the manageability of the binder.

OBJECTS AND SUMMARY OF THE INVENTION

A general object of the present invention is to provide a pocket in a binder which allows articles to be retained therein without damaging the articles, the materials retained in the binder, or effecting manageability of the binder.

Another object of the present invention is to provide a pocket and a binder which is positioned in unused space in the binder.

Another object of the present invention is to provide a pocket in a binder which provides easy and ready access to articles retained therein.

Still another object of the present invention is to provide a pocket in a binder which is capable of retaining articles placed therein.

Briefly, and in accordance with the foregoing, the present invention envisions a pocket on a binder which is formed for holding articles. The pocket is formed in a void of the binder formed between an inside surface of the cover of the binder and a retained edge of the components retained in a holding device in the binder. Various boundary components in the void define compartments in which the pocket is positioned. Since the void and the compartments defined therein are empty space, not utilized in the binder, the articles can be placed in the pocket without interfering with the operation of or damaging the binder, the materials retained therein, or the article.

BRIEF DESCRIPTION OF THE DRAWINGS

The organization and manner of the structure and operation of the invention, together with further objects and advantages thereof, may be understood by reference to the following description taken in connection with the accompanying drawings, wherein like reference numerals identify like elements, and in which.

DETAILED DESCRIPTION OF THE PREFERRED EMBODIMENT

Figure 1:
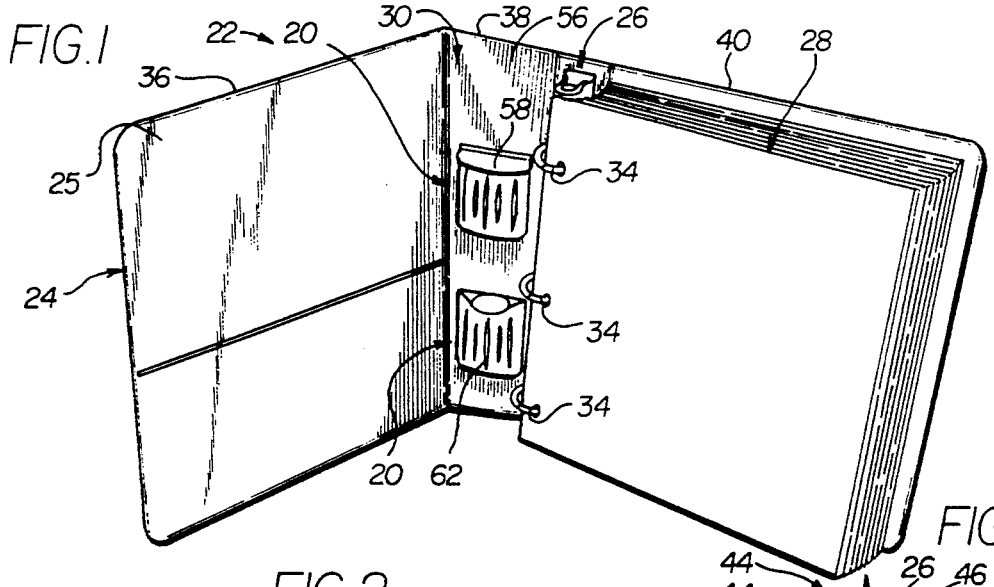
FIG. 1 is a perspective view showing an open binder in which a pocket of the present invention depending from an inside surface thereof.

While the invention may be susceptible to embodiment in different forms, there is shown in the drawings, and herein will be described in detail, embodiments with the understanding that the present description is to be considered an exemplification of the principles of the invention and is not intended to limit the invention to that as illustrated and described herein.

Figure 2:
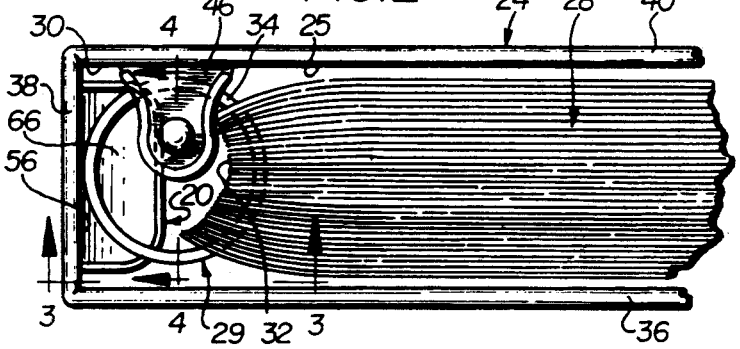
FIG. 2 is a top plan view of the binder as shown in FIG. 1 in which the cover is closed over material retained on a holding device showing the pocket extending into a void in the binder.
Figure 3:
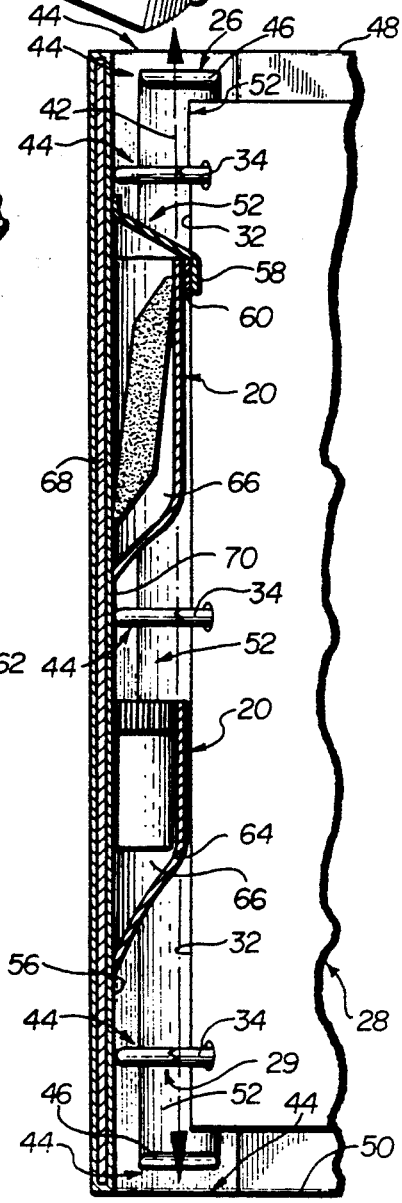
FIG. 3 is a partial fragmentary cross-sectional view taken along line 3—3 in FIG. 2 showing a side view of the pocket extending into a compartment defined within in the void.

With reference to FIGS. 1-3, a pocket 20 of the present invention is shown depending from a binder 22. The binder 22 has a cover 24 with an inside surface 25. A component holding device 26 is attached to the inside surface 25 of the binder. The contents 28 of the binder 22, shown herein as sheets of paper, are retained in the binder 22 by the holding device 26.

With further reference to FIGS. 2 and 3, when the cover 24 is closed, a void 29 is formed between a portion 30 inside surface 25 of the cover 28 and retained edges 32 of the contents 28. In other words, the edge of the paper through which a ring 34 extends forms one side of the void 29 with the portion 30 of the inside surface 30 of the cover 24 forming the other sides of the void 29.

The cover 24 can be a continuous piece of material to which the holding device 26 is attached or may be segmented with a front 36, middle 38 and back 40 portion of the cover 24 as shown in FIG. 1. Additionally, a variety of holding devices 26 may be attached to the cover 24 such as slide brackets or strap brackets as well as projecting posts.

A central axis 42 extends through the void 29 along the direction of elongation of the retained edge 32 of the contents 28. A number of boundary components 44 are disposed along the void 29 generally transverse to the central axis 42. As shown in FIG. 3, boundary components 44 include the rings 34, thumb levers 46 (used to open and close the binding rings), and a first edge 48 and a second edge 50 defined along a top and bottom edge of the cover 24 in the area of the void 29. The boundary components 44 subdivide the void 29 into compartments 52.

In prior art binders, the compartments 52 of the void 29 are unused volumes of the binder. These areas are structurally reinforced and protected by the structure of the binder. As such, articles retained in the pocket 20 of the present invention extending into the compartments 52 are generally protected from damage and do not interfere with the operation of the binder 22.

It should be noted that additional pockets could be positioned in the compartment 52 defined between a thumb lever 46 and a ring 34 or, if thumb levers 46 are not used, between the ring 34 and the first edge 48. A pocket 20 positioned towards the top of the binder 22 in this manner would allow access to articles retained therein without opening the binder. The pockets 20 as shown in the illustrations have an opening 54 spaced away from the ring 34. These openings 54 may be positioned in close proximity to the ring 34 such that when the binder 22 is closed, the rings 34 tend to act to retain the article in the pocket 20.

The pocket 20 may be attached to a front portion or the back portion 36,40 of the cover 24 such that the pocket 20 extends into the compartment 52 with sides extending along the retained edge 32 of the contents 28 and an inside surface 56 of the middle portion 38. Additionally, as shown in FIGS. 1 and 3, a cover flap 58 is used to cover the opening 54 of the pocket 22. The cover flap 58 and/or pocket 20 also include a fastener 60 to hold the cover flap 58 over the opening 54. A non-inclusive list of examples of fasteners 60 are: adhesive materials disposed on abutting surfaces of the cover flap 58 and the pocket 20, snap fasteners attached to either one of the pocket or cover flap 58; adjoining, interengaging portions of the flap 58 and pocket 20; as well as a Velcro-type products.

Figure 5:
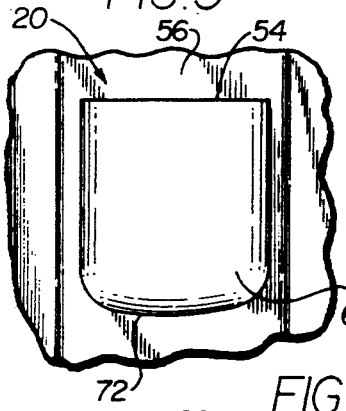
FIG. 5 is a view of pocket as shown in FIG. 4 showing a continuous cover member of the pocket.
Figure 4:
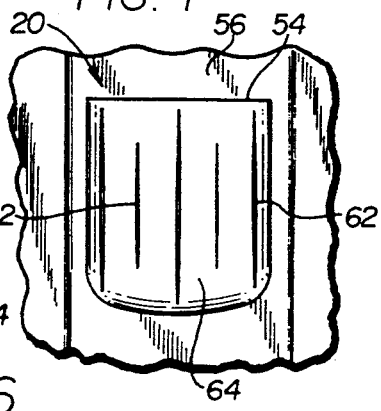
FIG. 4 is an enlarged partial fragmentary elevational view taken along line 4—4 in FIG. 2 of the pocket.
Figure 6:
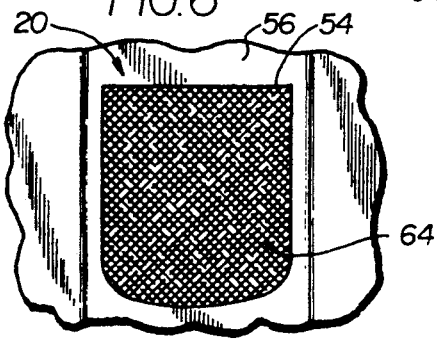
FIG. 6 is a view of a pocket as shown in FIG. 4 in which the cover material of the cover member is formed of a mesh material.

FIGS. 4, 5 and 6 show a number of specific ways in which the pocket 20 attached to cover 24 is fabricated. As shown in FIG. 4, the opening 54 of the pocket 20 is disposed along the top edge thereof. A number of slits 62 are formed on a cover portion 64 of the pocket 20 to allow the cover member portion 64 to expand away from the inside surface 25 of the cover 24. Clearly a variety of slitting patterns may be used to achieve a desired pocket shape. For example, the slits 62 may be arranged in a pattern to maximize an internal cavity 66 of the pocket, to form a recognizable pattern such as a logo or mark, or to conform to an article placed therein.

FIG. 5 shows a pocket 20 in which the cover member 64 is a continuous piece of material. This form of the pocket 20 has a cover member 64 which is formed of a resilient material. This pocket 20 may also be formed to partially plastically deform the cover portion 64 such that a cavity 66 is shaped in the cover portion 64.

FIG. 6 show a pocket 20 in which the cover portion 64 is formed of a mesh material. The mesh material provides characteristics including visibility, breathability, elasticity, as well as close conformance to the article retained therein.

The pockets 20 discussed hereinabove, may be attached to or formed in the cover 24 by a number of methods. Many binders are constructed with a generally rigid core 68 which is covered with a covering material 70. Typical core 68 materials include wood, plastic, cardboard or other suitable materials providing rigidity and strength. The covering material 70 provides a desired appearance as well as easy maintenance. One covering material 70 is a vinyl type of material having characteristics which include a degree of resiliency as well as strength. As such, the pocket 20 is formed by forming a slit through the covering material 70 to form the opening 54 and pre-expanding the cavity 66 for receiving articles or leaving the cavity unexpanded and expanding the cavity only upon inserting an article therein. The characteristics of a vinyl covering material 70 may be exploited such that if an article which is larger than the pre-formed or unformed cavity 66 is inserted therein, the covering material 70 of the pocket 20 tends to elastically contract around the article thereby further retaining the article in the cavity 66.

Additionally, the pocket can be formed with a cover member 64 which is a separate piece of material attached to the inside surface of cover 24. The separate cover member 64 is attached to the cover 24 by means of adhesive, heat bonding the material of the cover member 64 to the cover 24, stitching, or use of mechanical fasteners.

The present invention also includes a method of forming the pocket 20 when the cover 24 is formed with a core 68 and a covering material 70. Under the method, the covering material 70 is slit to form the opening 54. At this point the pocket may be further processed to form the slits 62 and the cover member 64 or left unprocessed as described hereinabove. Additionally, the method may further include expanding the cavity 66 to form a desired volume. In this regard, the shape of the cover member 64 may be other than that as shown in the figures. For example, the pockets 22 could be triangular, rectangular, circular, or any other desired shape. Further, when the covering material 70 is slit, a perimeter 72 of the pocket 20 may be processed to define the perimeter 72. Such perimeter defining may be achieved by heat bonding the covering material 70 to the core 68 or deforming the covering material 70 to define the perimeter 72.

In use, the binder 22 has a void area 29 formed between the cover 24 and the retained edge 32 of the contents 28 of the binder. The void 29 is subdivided into compartments 52 defined by the boundary components 44. The present invention provides the pocket 20 which is attached to the inside surface 25 of the cover 24 and positioned for nesting a corresponding compartment 52 between boundary components 44 of the retaining device 26.

While a preferred embodiment of the present invention is shown and described, it is envisioned that those skilled in the art may devise various modifications of the present invention without departing from the spirit and scope of the appended claims. The invention is not intended to be limited by the foregoing disclosure.

I claim:

1. A binder for retaining leafs and other components comprising:

a cover having an inside surface and an outside surface;

a holding device depending from said cover, said holding device having at least two component holders for retaining said leafs and other components in relation to said cover; said component holders retaining said leafs and components generally along a common edge of said leafs and components;

a void being defined by a portion of said inside surface of said cover and said common edges of said components retained on said component holders of said holding device;

at least one compartment in said void being defined by a volume of said void bordered by two component holders;

a pocket for holding articles being positioned on said inside surface of said cover for nesting in a corresponding one of said compartments.

2. A binder as recited in claim 1, wherein said pocket is expandable away from said inside surface of said cover.

3. A binder as recited in claim 2, wherein said pocket is expandable to a volume of less than or substantially equal to a volume of said corresponding compartment in which said pocket is nested.

4. A binder as recited in claim 1, wherein said pocket is formed of a mesh material attached to said cover, said mesh material allowing said pocket to expand into said corresponding compartment.

5. A binder as recited in claim 1, further comprising:

a flexible material having a degree of resiliency covering at least a portion of said inside surface of said cover; said material having an opening formed therein defining an open end of said pocket.

6. A binder as recited in claim 5, further comprising:

a pocket cavity of said pocket being formed by expanding said material between said opening and an adjoining boundary of said compartment.

7. A binder as recited in claim 5, further comprising an expandable pouch being formed by slitting said material between said opening and an adjoining boundary of said compartment.

8. A ring binder of the type having a cover including a front portion, a back portion, a middle portion, and at least two spaced-apart rings depending from said cover for retaining leafs and other components having holes formed therethrough for retention on at least one of said rings; said binder comprising:

said cover defining an inside cover surface, said leafs and components being retained along said at least one ring defining a common edge, a void being defined between said inside cover surface and said common edge of said leafs and components;

a central axis extending through said void generally parallel to said common edge;

boundary components including said at least two spaced-apart rings being disposed along said void, a volume of said void between a pair of spaced-apart boundary components defining a compartment, said ring binder having at least one compartment;

at least one pocket positioned on said inside cover surface of said cover for nesting within a corresponding one of said compartments.

9. A binder as recited in claim 8, wherein said pocket is expandable.

10. A binder as recited in claim 8, wherein said pocket is formed of a mesh material attached to said cover, said mesh material allowing said pocket to expand into said compartment.

11. A binder as recited in claim 8, further comprising:

a flexible material having a degree of resiliency covering at least a portion of said cover; said material having an opening formed therein defining an open end of said pocket.

12. A binder as recited in claim 11, further comprising an expandable pouch being formed by slitting said material between said opening and an adjoining boundary of said compartment.

13. A binder having a cover including front, back, and middle portions defining an inside surface in which leafs and other components are retained; said front portions and back portions being hingedly attached to said middle portion; at least two component holders being attached to, and spaced apart along, said inside surface of said cover; a volume bounded by said said middle portion and a portion of said front and back portions of inside surface of said cover and edges of components retained on said component holders defining a void; boundary components being operatively associated with said binder, a volume of said void bounded by said boundary components defining compartments in said void; said pocket comprising:

a cover member depending from said inside surface of said cover and disposed within a corresponding compartment, at least a portion of one edge of said cover member being displaceable relative to said cover to which said cover member is attached, said portion of said edge of said cover member defining an opening, a pocket being defined between said cover member and said cover to which said cover member is attached said pocket having a volume substantially equal to or less than said corresponding compartment, said pocket cavity being accessible through said opening.

14. A binder as recited in claim 13, wherein at least a portion of said cover from which said pocket depends is formed of a generally rigid core covered by a generally flexible material, said cover member of said pocket being integrally formed with said cover material, said opening along one portion of a side of said cover member being formed in said cover material.

15. A binder as recited in claim 14, wherein a portion of said cover member includes at least one slit formed therethrough between an edge of said defined by said opening and a corresponding boundary component, opposite edges of said slit being displaceable for providing expansion of said cover member to allow the volume of said pocket to be varied.

16. A binder as recited in claim 14, wherein said cover material is a flexible material having a degree of resiliency such that when a item is placed through said opening into said pocket said cover member at least partially, elastically stretches for retaining articles disposed therein.

17. A binder as recited in claim 16, wherein said cover material is a flexible material having a degree of resiliency such that when a item is placed through said opening into said pocket said cover member at least partially, elastically stretches for retaining articles disposed therein.

18. A method for forming a pocket on a base section on an inside surface of a binder, a cover of said binder having front, middle, and back over portions, a section of at least one of said cover portions defining said base section on which said pocket is formed; a component holding device for retaining leafs or other components between said front, middle and back cover portions attached to said cover, said base section on which said pocket is formed having a generally rigid core component and an overlying cover material component, a void being defined between said front, middle and back cover portions and a common edge of said components retained on said component holding device, boundary components being disposed on at least one of said front, middle and back cover portions defining compartments in said void, said pocket being disposed within a corresponding one of said compartments, said method comprising the steps of:

slitting said cover material on said base in an area limited by a pair of neighboring boundary components, said slit forming an opening providing an opening into said pocket having a positive volume of a range substantially equal to or less than a volume of said compartment.

19. A method of forming a pocket in a binder as recited in claim 18, further comprising the steps of:

forming an opening through said cover material of said pocket between an edge of said pocket defined by said opening and a corresponding boundary component for for allowing the volume of said pocket to be varied within said range.

20. A method of forming a pocket in a binder as recited in claim 18, said method further comprising the steps of:

at least partially, plastically deforming said cover material of said pocket to expand said pocket into said corresponding compartment.

* * * * *